US005788607A

United States Patent [19]

Baker

[11] Patent Number: 5,788,607

[45] Date of Patent: Aug. 4, 1998

[54] THERAPEUTIC WRIST ROTATOR

[76] Inventor: Edwin L. Baker, 105 Fir Trail, Marshall, Tex. 75670

[21] Appl. No.: 779,739

[22] Filed: Jan. 7, 1997

[51] Int. Cl.[6] ..... A63B 21/00

[52] U.S. Cl. ..... 482/44; 482/4; 482/45; 482/903

[58] Field of Search ..... 128/782, 779; 116/317, 316, 309, 293, 296, 307, 323; 482/1–9, 44–46, 900, 901, 903, 905

[56] References Cited

U.S. PATENT DOCUMENTS

| | | | |
|---|---|---|---|
| 2,819,081 | 1/1958 | Touraine . | |
| 4,195,589 | 4/1980 | Blattner | 116/296 |
| 4,641,832 | 2/1987 | Mattox | 482/45 |
| 4,644,938 | 2/1987 | Yates et al. . | |
| 4,665,900 | 5/1987 | Saringer . | |
| 4,770,409 | 9/1988 | Wallisch . | |
| 5,067,479 | 11/1991 | Saringer et al. . | |
| 5,184,994 | 2/1993 | Morris et al. | 482/903 |
| 5,219,323 | 6/1993 | Singer et al. . | |
| 5,380,259 | 1/1995 | Robertson et al. . | |
| 5,458,560 | 10/1995 | Kaiser et al. . | |
| 5,484,394 | 1/1996 | Singer et al. . | |
| 5,503,619 | 4/1996 | Bonutti . | |
| 5,569,124 | 10/1996 | Raynie et al. . | |
| 5,597,373 | 1/1997 | Bond et al. | 482/4 |

*Primary Examiner*—Richard J. Apley
*Assistant Examiner*—Glenn E. Richman
*Attorney, Agent, or Firm*—Richard C. Litman

[57] ABSTRACT

A therapeutic wrist rotator provides for the passive rotation of the wrist of a user of the device for rehabilitation of the wrist after injury or disease. The device includes a case which is adapted to be immovably affixed to a stationary object in order to resist the forces applied during use. The case includes an electric motor driving a reduction drive to provide relatively slow rotational speed and relatively high torque to an output shaft. The output shaft includes a handgrip extending therefrom. On/off and rotational direction switches are provided to control the operation of the device, which may be powered by conventional alternating current or by one or more batteries. A protractor dial surrounding the output shaft provides an indication of the rotation achieved during use of the device, and a pair of indicators provides an indication of the maximum rotational movement in both clockwise and counterclockwise directions. The device is used by gripping the handgrip and activating the switches to cause the output shaft and handgrip to rotate slowly in the desired direction. The device may be shut off or the direction of rotation reversed as desired. In the event that excessive rotation occurs, the user may merely release the handgrip. Rehabilitation progress may be measured by noting the maximum position of the indicators following each session of use.

10 Claims, 3 Drawing Sheets

THERAPEUTIC WRIST ROTATOR

BACKGROUND OF THE INVENTION

1. Field of the Invention

The present invention relates generally to powered and/or mechanized therapeutic devices providing for the rehabilitation of the body after injury or illness, and more specifically to an electrically powered rotator which is geared to provide a suitable torque at a very low rpm for the powered manipulation of the wrist. The device includes a small electric motor with a suitable gear reduction system, and a handle affixed to a rotary shaft. The device may include a dial and indicator for the user to measure the amount of rotation, as well as markers indicating the maximum amount of rotation achieved in a given operation of the device.

2. Description of the Prior Art

The human wrist is a relatively complex structure, and damage to the wrist can result in injuries which are difficult and time consuming to heal. Traditionally, the injured wrist is immobilized to permit the joining of broken bones and torn tendons, as well as to allow the healing of inflamed tendons. After the structure has healed, it can be difficult to develop full muscular strength and flexibility in the wrist, as the muscles and tendons tend to atrophy to a certain degree due to the immobilization.

Accordingly, therapists have long been aware of the need to exercise the wrist, gradually building up the strength and mobility of the joint until optimum strength and mobility have been reached. Such therapy is quite costly due to the specialized equipment often used, as well as the cost of usually personalized therapy provided by a specialist. Various specialized machines and equipment have been developed in the past for the purpose of providing some form of therapy to the wrist, but most require active muscular input from the user, and the development of muscular strength for such input does not necessarily provide the flexibility needed, as it is important that the muscular structure be stretched gradually, as well as that the muscles be made to contract to develop strength. Those few passive devices known to the inventor, provide only for the flexing of a joint, rather than for its rotation. A discussion of the prior art known to the inventor, and its distinctions from the present invention, is provided below.

U.S. Pat. No. 2,819,081 issued on Jan. 7, 1958 to John Touraine describes Exercisers comprising a wheeled platform having an outer ring affixed thereto, with a rotatable inner ring and diametric hand grip located within the outer ring. A forearm cuff is affixed to the platform. Friction between the inner and outer rings is adjustable by set screws. A user secures the wrist in the cuff and grips the hand grip to rotate the inner ring relative to the outer ring. The device is entirely passive, requiring active muscular input from the user, rather than providing passive manipulation of the wrist, as in the present invention.

U.S. Pat. No. 4,644,938 issued on Feb. 24, 1987 to Jan B. Yates et al. describes a Hand Exerciser providing for active alternate tension and relaxation of the fingers of the hand. No rotational movement is provided. The device secures to a splint on the back of the wrist and hand, and alternately pulls the back of the fingers, as in opening the hand, and relaxes to allow the hand to close partially. While the device is active to provide passive manipulation, it provides no therapy for wrist rotation, as provided by the present invention.

U.S. Pat. No. 4,665,900 issued on May 19, 1987 to John H. Saringer describes a Device For Imparting Continuous Passive Motion To Human Joints. The device is secured to a wrist splint and includes a series of tensile cables which are applied to the fingers and/or thumb of the hand. The device provides much the same function as the Yates et al. device discussed above, by actively pulling the fingers back to provide passive therapy thereto. Either active or passive wrist rotation is impossible due to the wrist splint to which the device is attached, as in the Yates et al. device.

U.S. Pat. No. 4,770,409 issued on Sep. 13, 1988 to Michael D. Wallisch describes a Wrist Exercise Device, comprising a pair of rotatable circular components each having a diametric grip therein. The circular components are housed in a common housing, and each biased to a neutral position by a spring. The device is entirely passive and requires active muscular input by the user, unlike the present wrist rotator.

U.S. Pat. No. 5,067,479 issued on Nov. 26, 1991 to John Saringer et al. describes a Continuous Passive Motion Device, comprising a base which is strapped to the forearm above the wrist with an adjustably eccentric drive mounted thereon. The drive operates a rod passing above the wrist and the back of the hand, to a grip extending therebelow for the user's hand. The device may be used to provide passive reciprocal motion to the wrist in either of two planes or a combination thereof. No wrist rotation is provided, nor is any such rotation possible using the Saringer et al. device.

U.S. Pat. No. 5,219,323 issued on Jun. 15, 1993 to Robert D. Singer et al. describes a Method And Apparatus For Rotating A Wrist, comprising a series of cuffs for the upper arm, forearm, and hand. The device provides for extremely limited rotary motion of the wrist, due to the relatively short links between the forearm and hand cuffs. A motorized embodiment is provided, but the motor provides for the active movement of the forearm relative to the upper arm through an extremely limited range. No powered means providing for the passive rotational movement of the wrist is disclosed, as provided by the present invention.

U.S. Pat. No. 5,380,259 issued on Jan. 10, 1995 to David L. Robertson et al. describes an Arm, Hand And Wrist Exercising Device comprising a complex structure using a spring loaded lever arm to provide resistance to the user. One embodiment includes a rotary wheel and hand grip, to which a user must apply active force against a lever arm and spring connected thereto. No powered means providing passive wrist rotation is disclosed.

U.S. Pat. No. 5,458,560 issued on Oct. 17, 1995 to Robert T. Kaiser et al. describes a Continuous Passive Motion Device For A Wrist, comprising a housing which fits against the forearm and which contains a drive mechanism to reciprocate the wrist passively, upwardly and downwardly. The device also includes means providing for lateral arcuate movement of the wrist, but no means is provided to rotate the wrist passively and axially, as is provided by the present invention.

U.S. Pat. No. 5,484,394 issued on Jan. 16, 1996 to Robert D. Singer et al. describes a Method And Apparatus For Rotating A Wrist, similar to the '323 patent to the same inventors discussed further above. Further powered actuating means have been added in the '394 patent, but no means is provided for wrist rotation, either passively by powered means or actively against a passive machine, using the muscular power of the user.

U.S. Pat. No. 5,503,619 issued on Apr. 2, 1996 to Peter M. Bonutti describes an Orthosis For Bending wrists, comprising a jackscrew arrangement secured perpendicularly to the wrist joint. As the screw is turned, arms connected thereto advance or retreat along the screw threads, to move forearm and hand cuffs hingedly relative to one another. The device may be motorized to provide passive movement for the user. No axial rotation of the wrist relative to the forearm is provided by Bonutti, as is provided by the present invention.

Finally, U.S. Pat. No. 5,569,124 issued on Oct. 29, 1996 to Arthur D. Raynie et al. describes an Arm, Hand, And Wrist Exercising Device similar to that described in the '259 patent, discussed further above. Again, no powered means for rotating the wrist is disclosed, as provided by the present invention, and the range of rotation is relatively limited in both this device and that of the '259 patent discussed further above.

None of the above inventions and patents, taken either singly or in combination, is seen to describe the instant invention as claimed.

SUMMMARY OF THE INVENTION

By the present invention, a therapeutic wrist rotator is disclosed. The device includes a case which is immovably affixed to a stationary surface, and which contains an electric motor and reduction drive to drive a rotary output shaft. The output shaft includes a handgrip extending therefrom, so a user may grip the handle with the device turning the handle slowly to rotate the user's wrist progressively. The device may also include a protractor scale with maximum rotation indicators for each direction, so the user may determine the maximum degree of rotation achieved during the use of the device.

Accordingly, it is a principal object of the invention to provide an improved therapeutic wrist rotator which provides for the passive rotation of a user's wrist by active electric motor means, for the rehabilitation of the wrist after damage thereto.

It is another object of the invention to provide an improved wrist rotator which includes a case which is immovably affixed to the surface of a stationary object, to preclude movement of the device during use.

It is a further object of the invention to provide an improved wrist rotator with a relatively small electric motor and a reduction drive to an output shaft, with the output shaft being adapted to turn at a slow speed while developing relatively high torque to rotate the wrist of the user passively.

Yet another object of the present invention is to provide an improved wrist rotator with an easily gripped and released hand grip extending from the output shaft.

An additional object of the invention is to provide an improved wrist rotator including on/off and reverse switch means, which motor may be powered by conventional alternating electrical current or by batteries.

Still another object of the invention is to provide an improved wrist rotator which includes a protractor scale for the determination of the rotation of the hand grip, and indicators displaying the maximum rotation of the shaft in each direction.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
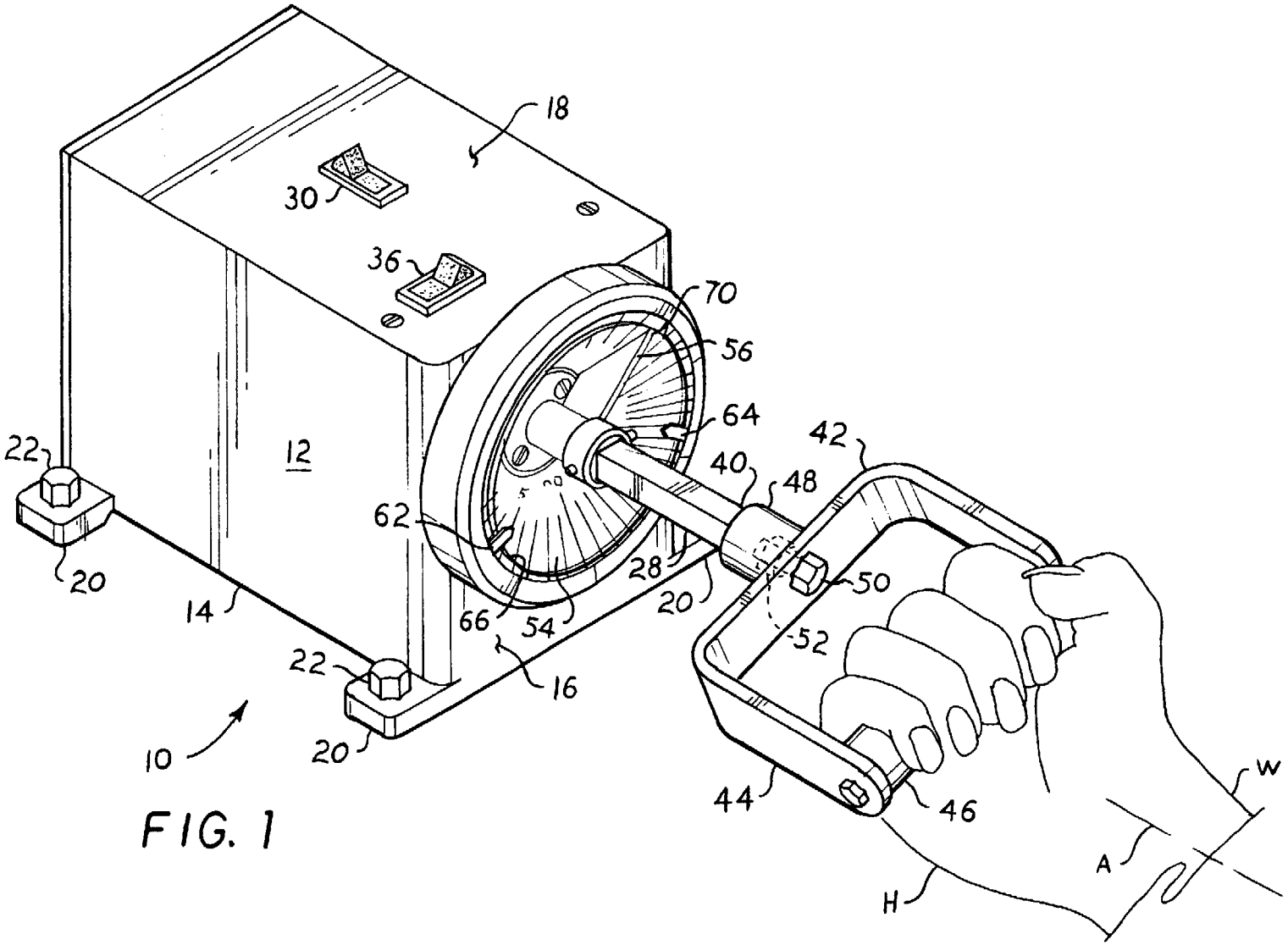
FIG. 1 is a perspective view of the present therapeutic wrist rotator in operation, showing its use and general features.

The present invention, shown in use in FIG. 1, comprises a therapeutic wrist rotator 10 which provides for the passive rotation of a user's wrist W by means of an actively powered device. The wrist rotator 10 includes a housing comprising a closed, rectangular case 12, with the case 12 including at least a lower edge 14, forward end 16, and an upper surface 18.

As the rotator 10 provides for the passive rotation of the wrist W, it is important that means be provided to mount the rotator 10 immovably to a stationary object at least while the rotator 10 is in use in order to preclude a counter torque from twisting the rotator 10. Accordingly, a plurality of mounting lugs 20 is provided, extending from the lower edge 14 of the case or housing 12. These mounting lugs provide for the affixing of the case 12 of the rotator 10 to a fixed object or surface, by means of bolts 22 or other suitable means (clamps, etc.) as desired.

Figure 3:
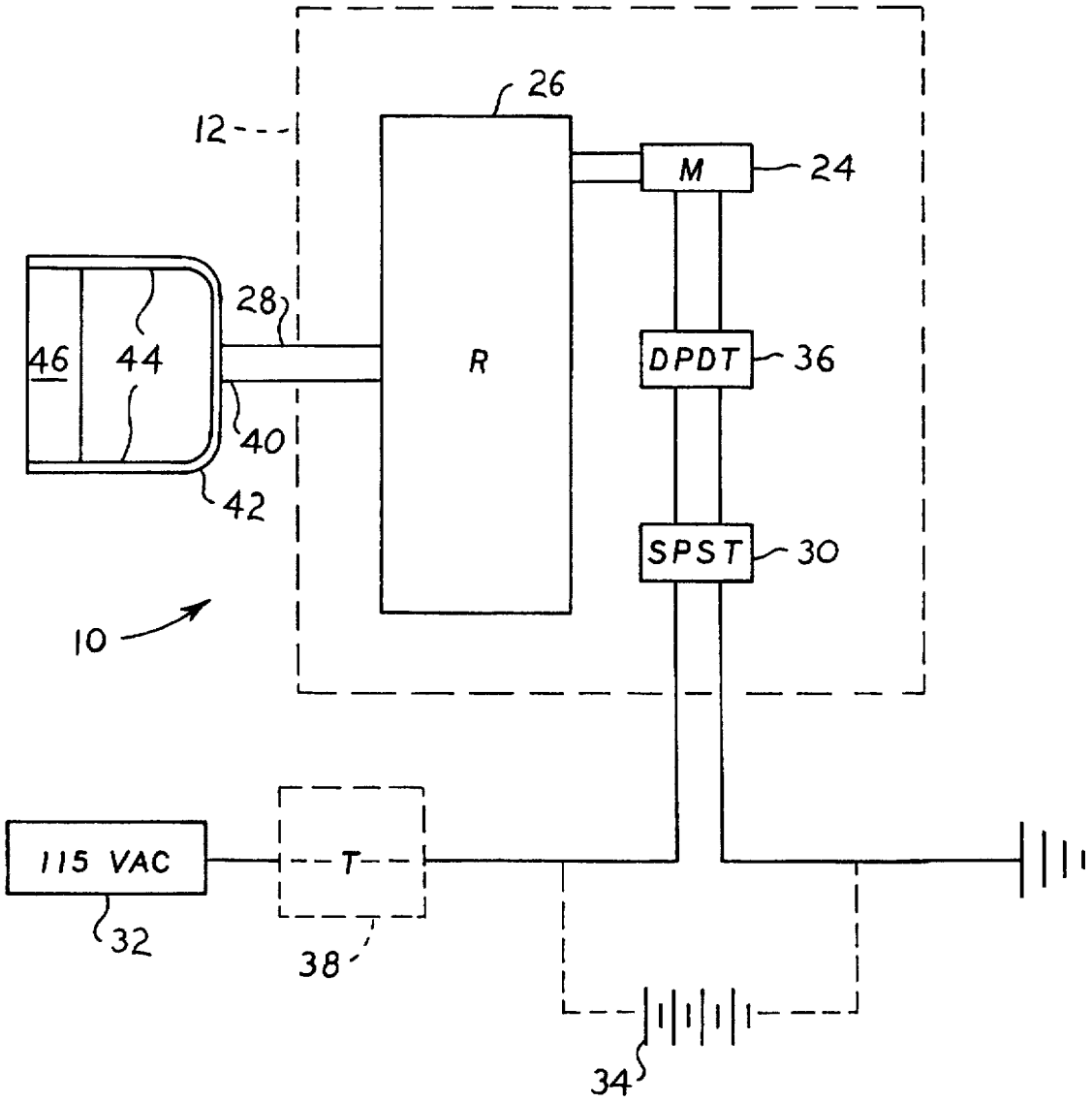
FIG. 3 is an electrical schematic diagram of the electrical components and circuitry of the present therapeutic wrist rotator.

A relatively small electric motor 24, shown schematically in FIG. 3, is provided within the case 12, with the motor 24 driving a reduction drive 26 (gear reduction or other speed reduction means). The reduction drive 26 is also disposed within the case 12 and has an output shaft 28 extending therefrom, which extends outwardly through the forward end 16 of the case 12 and which external portion is shown in each of the drawing figures.

The motor 24 need only provide a fraction of a horsepower, or on the order of 200 to 300 watts, allowing for electrical and friction losses, as the gear reduction serves to turn the output shaft on the order of one half to one revolution per minute, to allow the user sufficient time for the wrist muscles and tendons to absorb the torque slowly. The speed reduction drive 26 is on the order of that provided in an electric clock, to reduce the speed of the electric motor therein from e. g., 2,000 rpm to one rpm to drive the second hand of the clock. The great speed reduction provided by the reduction drive 26 thus also provides a significant torque multiplication, on the order of sixty pound-inches (five pound-feet) of torque at the output shaft 28 to allow the use of a relatively small electric motor 24.

The motor 24 is controlled by a single pole, single toggle on/off switch 30, preferably mounted atop the upper surface 18 of the case or housing 12. The on/off switch 30 is electrically connected in series with an electrical power supply, such as a supply of 115 volt alternating current 32, or alternatively one or more electrical cells or batteries 34.

A second switch 36 of double pole double toggle configuration is also provided atop the upper surface 18 of the case 12, in series with the on/off switch 30 and motor 24. This switch 36 may be wired with a crossover to provide for the reversal of direction of operation of the motor 24, to provide either clockwise or counterclockwise rotation of the output shaft 28 as desired. The two switches 34 and 36 may be rocker type switches, as shown in FIG. 1, or any other suitable type of electrical switch as desired. Preferably, the orientation of the reverse switch 36 is such that operation of a given end of the switch will cause the output shaft 28 to turn in that direction.

A motor 24 operating on 115 volt alternating current, will draw approximately two to two and one half amps to develop the desired sixty pound-inches of torque at one rpm, depending upon electrical losses and friction losses in the reduction drive. Motors rated at other voltages may be used as desired, with appropriate adjustment for their requirements. As an example, a 36 volt alternating current motor providing the appropriate power (approximately six to seven and one half amps) may be used, in which case a transformer 38 may be provided to provide the required stepdown voltage. While the power required to operate the present wrist rotator 10 is beyond that provided by smaller conventional dry cell batteries, a relatively small and lightweight rechargeable battery, such as a motorcycle battery or the like, would provide the required eighteen to twenty two amps which might be required of a twelve volt motor. Other configurations may be substituted.

Returning to FIG. 1, the output shaft 28 includes a distal end 40 to which a handgrip 42 is removably secured. The handgrip 42 is preferably of a laterally symmetrical configuration relative to the elongate output shaft 40, having a generally U-shaped bracket 44 with a grip 46 extending thereacross. (It should be noted that the complete view of the grip 46 of FIG. 3 is shown only schematically, and that the grip 46 is preferably shaped or configured to conform to the shape of the clinched palm of the hand H when the grip 46 is being gripped.) The grip 46 may be formed of any suitable firm or resilient material, and/or provided with padding, as desired.

Removability of the handgrip 42 from the output shaft 28 is provided by a socket 48 (i. e., of the type which is used in combination with a ratchet wrench for working with threaded fasteners) which is permanently affixed to the distal end 40 of the output shaft 28. The central portion of the handgrip bracket 44 includes a bolt 50 therethrough, with the bolt 50 being secured in place by a nut 52 (shown in broken lines) on the opposite side of the bracket 44 from the head of the bolt 50. (The assembly may be permanently secured together, e. g., by means of welding, brazing, thread locking compound, locking fasteners, etc., as required to preclude loosening of the assembly in use.) The nut 52 is inserted into the open end of the socket 48, with the nut 52 correctly sized to fit closely within the socket 48 to lock the nut 52 and socket 48 rotationally, and thus the output shaft 28 and handgrip 42 to transfer torque therebetween.

The above described therapeutic wrist rotator 10 provides an excellent means of passively and axially rotating the wrist W of a user of the device along the elongate axis A of the wrist W by actively rotating the handgrip 42 as described above. However, some means of determining the maximum rotation of the wrist W in each direction (clockwise and counterclockwise) from a neutral position, would be of great value in such a device, by allowing the user to keep track of progress as the wrist therapy progresses.

Figure 2:
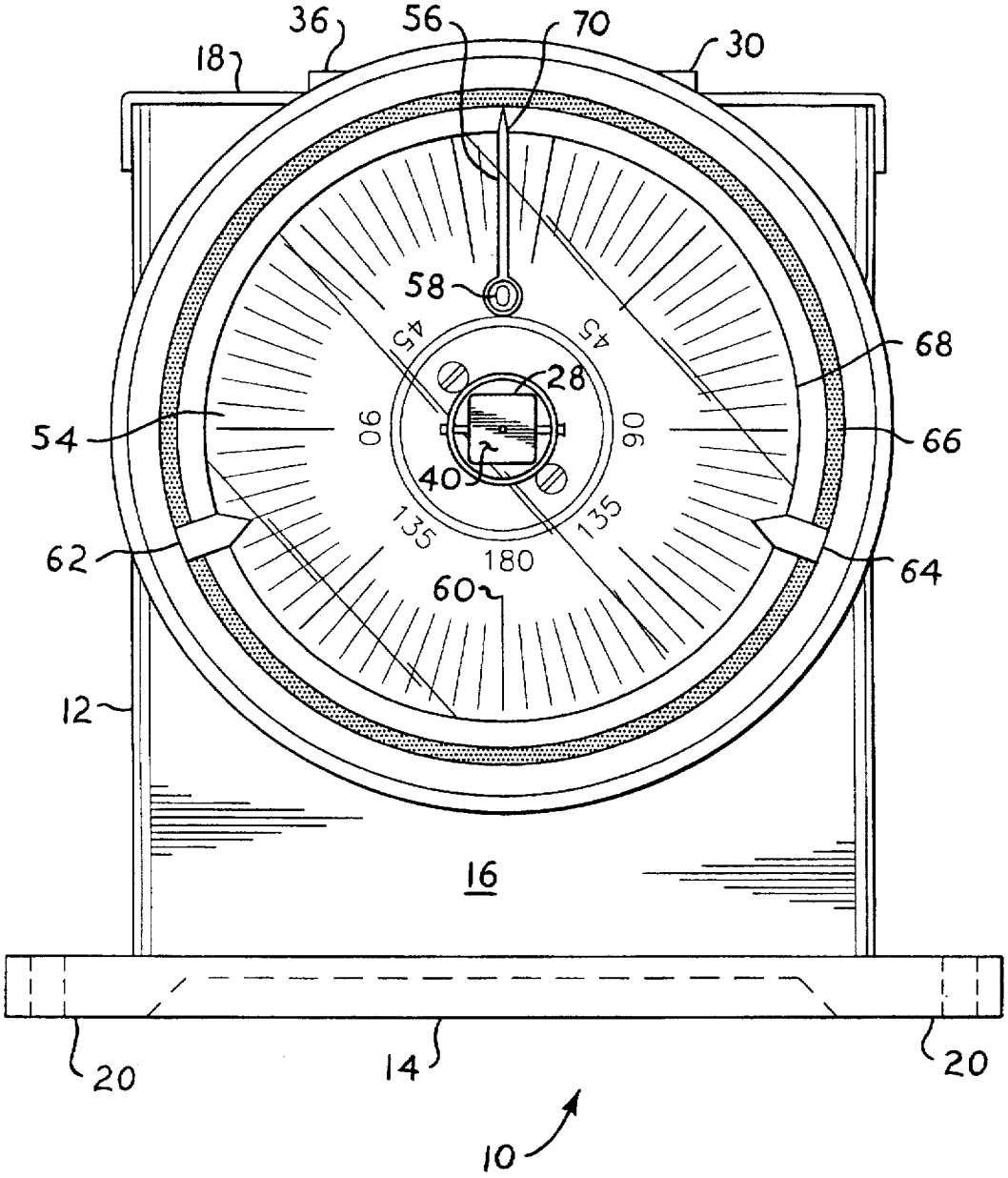
FIG. 2 is a front end elevation view with the handgrip removed, to show the protractor scale and maximum rotation markers.

Accordingly, a protractor scale 54 is immovably affixed to the forward end 16 of the case 12, with a handgrip rotation indicator 56 being immovably affixed to the output shaft 28 and extending radially outwardly therefrom. (The indicator 56 may be affixed to a clear disc, which is in turn affixed to the output shaft 28.) The protractor scale 54 preferably has an origin point 58 (zero degrees of rotation) aligned with the top of the scale, with the scale increasing in both the clockwise and counterclockwise directions to a maximum rotational deflection point 60 of 180 degrees at the bottom of the scale, shown clearly in FIG. 2. This accommodates the normal orientation of the extended wrist, where an axis through the clinched palm is normally oriented approximately vertically. The rotation of the output shaft 28 and handgrip 42, along with the rotation indicator 56 relative to the fixed protractor scale 54, provides a direct indication of the number of degrees of rotation achieved at any given point. Major marks may be provided each 45 degrees, with minor marks every five degrees therebetween, as shown in FIG. 2, or other scale indications may be provided as desired.

While the above described protractor 54 and indicator 56 provide real time indications of the progress of wrist therapy, no lasting indication is provided. It will be seen to be desirable to provide some automatic means of recording the maximum rotation of the wrist W while using the present rotator 10.

Accordingly, first and second movable rotational progress indicators, respectively 62 and 64, may be provided to indicate respectively the maximum counterclockwise and clockwise rotation of the wrist W while gripping the rotating handgrip 42 as driven by the output shaft 28. These two indicators 62 and 64 are movably retained within a circumferential slot 66 which extends completely around the fixed protractor scale 54. No internal means is provided for the movement of the two progress indicators 62/64, so they will thus retain any given position to which they have been moved about the scale 54 by external means.

It will be seen that the two progress indicators 62 and 64 extend radially inwardly toward the output shaft 28 and protractor scale 54, across the outermost edge 68 of the scale 54. It should also be noted that the outermost end 70 of the output shaft and handgrip rotation indicator 56, extends beyond the outermost edge 68 of the protractor scale 54, and thus beyond the inwardly extending portions of the progress indicators 62 and 64. At least this outermost end 70 of the pointer 56 is coplanar with the two progress indicators 62 and 64, and will thus interfere with either of the two indicators 62/64 if rotation of the pointer 56 encounters either of them during operation of the rotator 10.

Accordingly, when the on/off switch 30 is turned on to activate the motor 24, the rotation indicator 56 rotates with the output shaft 28 in the direction selected (clockwise or counterclockwise) according to the direction reversing switch 36. When the outermost end 70 of the rotation indicator 56 contacts either of the progress indicators 62 or 64, depending upon the direction of rotation, the rotation indicator 56 will push the appropriate progress indicator further around in its circumferential track 66 around the protractor scale 54. When the maximum wrist rotation achievable at that point is reached, the user need only switch the direction reversal switch 36 in the opposite direction to reverse the rotation of the motor 24, to cause the output shaft 28 (and indicator 56) to reverse the direction of rotation and slowly rotate in the opposite direction. The affected progress indicator 62 or 64 will meanwhile remain at the last position to which it was pushed by the rotation indicator 56, until it is either moved further in a subsequent rotation or until it is reset by the user of the present wrist rotator 10.

In summary, the present therapeutic wrist rotator 10 will be seen to provide a most useful means of exercising a wrist which has been injured or otherwise damaged, to rehabilitate the wrist and to bring it back to substantially full strength and flexibility. A user of the present device need only grip the handgrip handle 46, turn on the switch 30, and allow the active rotational means of the device to rotate the wrist W passively, without any muscular effort on the part of the user, other than gripping the handgrip 42.

No clutch or other means of restricting the torque produced, or restricting the maximum travel of the device, is required, as the user need only flip the reversal switch 36 to stop rotation in one direction and initiate rotation in the opposite direction. Alternatively, the user need only shut off the device with the on/off switch 30, as desired. The rotation of the output shaft 28 and handgrip 42 are sufficiently slow (one half to one revolution per minute) that the user will have adequate time to operate either of the switches 30 or 36 as desired. If for some reason the user cannot reach either of the switches 30 or 36, he or she need only release the handle 46 to relieve any excessive strain which might otherwise occur, so it will be seen that the present device 10 is perfectly safe for all users and performs a most valuable therapeutic and rehabilitation function while being considerably less costly, yet more effective, than many devices developed heretofore for the same purpose.

It is to be understood that the present invention is not limited to the sole embodiments described above, but encompasses any and all embodiments within the scope of the following claims.

I claim:

1. A therapeutic wrist rotator providing for the passive axial rotation of a wrist of a user thereof, comprising:

a housing including mounting means for immovably attaching said housing to a stationary object;

an electric motor installed within said housing;

a reduction drive driven by said electric motor, said reduction drive also installed within said housing;

a first switch communicating with said motor for activating and deactivating said motor;

a second switch mounted on said housing, said second switch communicating with said motor for reversing the direction of rotation of said motor;

an output shaft rotated by said reduction drive, said output shaft extending through said housing and having a distal end; and a handgrip disposed on said distal end of said output shaft; whereby the user grips said handgrip and actuates said first switch to passively axially rotate the wrist of the user for therapeutically rehabilitating the wrist and upon reaching a point of maximum wrist rotation actuates said second switch to reverse rotation of said handgrip.

2. The therapeutic wrist rotator according to claim 1, wherein:

said housing includes a forward end having a fixed protractor scale disposed thereupon and surrounding said output shaft, and a handgrip rotation indicator extending radially outwardly from said output shaft adjacent said protractor scale for indicating the amount of rotation on said protractor scale of said output shaft and said handgrip relative to said housing.

3. The therapeutic wrist rotator according to claim 1, including:

movable rotational progress indicators, for displaying the maximum degree of rotation achieved by said output shaft and said handgrip.

4. The therapeutic wrist rotator according to claim 2, wherein:

said protractor scale includes a circumferential slot disposed therearound, with said slot including a first and a second movable rotational progress indicator movably installed therein and extending radially inwardly therefrom toward said output shaft and said protractor scale;

said handgrip rotation indicator extending from said output shaft and at least slightly beyond each said rotational progress indicator and coplanar therewith for moving each said rotational progress indicator about said slot to provide an indication of maximum clockwise and counterclockwise rotation of said output shaft, said handgrip, and said handgrip rotation indicator.

5. The therapeutic wrist rotator according to claim 1, wherein:

said housing includes a lower edge, and said mounting means comprises a plurality of mounting lugs extending therefrom.

6. The therapeutic wrist rotator according to claim 1, wherein:

said reduction drive provides a speed reduction and torque multiplication from said electric motor to turn said output shaft at between one half and one revolution per minute and to develop a torque of about sixty pound-inches at said output shaft.

7. The therapeutic wrist rotator according to claim 1, wherein:

said handgrip has a generally U-shaped bracket and is laterally symmetrical relative to said output shaft.

8. The therapeutic wrist rotator according to claim 1, wherein:

said handgrip is removable from said output shaft, with said output shaft including a socket extending therefrom and said handgrip including a fastener secured thereto adapted to fit removably within said socket and to transfer torque from said output shaft and said socket thereon to said handgrip.

9. The therapeutic wrist rotator according to claim 1, wherein:

said motor is powered by alternating current electrical power.

10. The therapeutic wrist rotator according to claim 1, wherein:

said motor is powered by at least one battery.

* * * * *